United States Patent [19]

Foster et al.

[11] 4,236,538

[45] Dec. 2, 1980

[54] SMOKING ARTICLES

[75] Inventors: Norman Foster, Southampton; Alan G. Stephenson, Ringwood, both of England

[73] Assignee: British-American Tobacco Company Limited, London, England

[21] Appl. No.: 837,538

[22] Filed: Sep. 28, 1977

[30] Foreign Application Priority Data

| | | | |
|---|---|---|---|
| Oct. 4, 1976 | [GB] | United Kingdom | 41102/76 |
| Nov. 26, 1976 | [GB] | United Kingdom | 49446/76 |
| Jan. 25, 1977 | [GB] | United Kingdom | 2985/77 |

[51] Int. Cl.[3] ..... A24B 3/00; A24B 3/14

[52] U.S. Cl. ..... 131/149; 131/140 C; 101/32; 156/157; 101/32

[58] Field of Search ..... 131/149, 15 R, 15 C, 131/77, 20 A, 58, 62, 67, 68, 69, 78, 79, 140 C, 31, 20 R, 17

[56] References Cited

U.S. PATENT DOCUMENTS

| | | | |
|---|---|---|---|
| 3,070,481 | 12/1962 | Schornstheimer | 156/582 |
| 3,858,159 | 1/1975 | Carter et al. | 156/583.2 |
| 4,109,665 | 8/1978 | Godfrey et al. | 131/15 C |
| 4,135,962 | 1/1979 | Sinclair et al. | 156/555 |
| 4,144,896 | 3/1979 | Daenen | 131/149 |

*Primary Examiner*—V. Millin

*Attorney, Agent, or Firm*—Kane, Dalsimer, Kane, Sullivan & Kurucz

[57] ABSTRACT

The invention concerns a method of lap joining pieces of tobacco in which the said pieces are placed in overlapping relationship and the overlapping portions are adhered to each other, without using extraneous adhesive, by the application to them of pressure and/or rapid heating. Pressure may be applied between rollers or between jaws, particularly the jaws of an electrical impulse-heating machine. In this case, the overlapping portions lap joined by the rapid application of heat and pressure may be cooled while still held between the said jaws. Prior or subsequent to lap joining, a consolidating agent may be applied to end portions of the tobacco pieces.

14 Claims, 6 Drawing Figures

SMOKING ARTICLES

Figure 1:
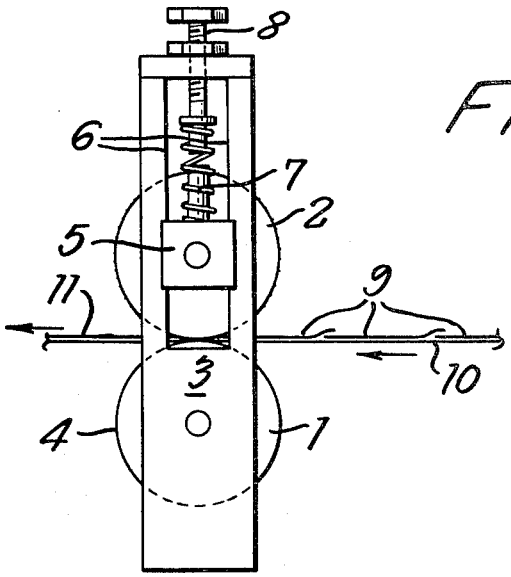

This invention relates to smoking articles and provides a method and apparatus for lap joining strips of tobacco to form a continuous length of tobacco for, for example, use in a cigar over-rolling machine to wrap cigars.

Methods are known in cigar manufacture for producing from strips of tobacco leaf continuous lengths of wrapping by lap joining the strips by means of an adhesive applied to the strips.

However, adhesives commonly used in the tobacco industry give rise to problems in one or more of the following areas when employed in joining tobacco strips to form a length of cigar wrapping.

The adhesive must not give rise to toxicity when a cigar having the wrapping is smoked, nor must the adhesive create an unacceptable off-taste in the smoke.

With known methods, it is necessary for the tobacco to be moist so that it is not too brittle to be handled. In order to obtain a rapid build-up of bond strength, therefore, a solvent-based adhesive is preferred to one with an aqueous base, since an aqueous-based adhesive would set comparatively slowly when applied to a material having a significant water content. However, the use of solvent-based adhesives necessitates provision for adequate ventilation of the place where the adhesive is applied, the strips are joined and the solvent vaporizes.

In known methods, the wrapping, together with a carrier band, is reeled onto a bobbin. However, difficulty has been caused by the adhesive being squeezed from between the opposed surfaces of the strips of tobacco, the wrapping thereby becoming adhered to the carrier band .

Wrapping produced by the known methods must be stored for a number of hours, commonly twenty-four hours, before sufficient bond strength is attained for the wrapping to be used in a cigar over-rolling machine.

The present invention seeks to provide a method of lap joining pieces of tobacco which obviates the aforesaid drawbacks of known methods in simple fashion.

According to the invention, a method of lap joining pieces of tobacco, without using extraneous adhesive to effect the joining, comprises placing the said pieces of tobacco in overlapping relationship and adhering the overlapping portions to each other by the application to them of pressure and/or rapid heating.

Pressure may be produced on the overlapping portions of the pieces of tobacco between rollers or between jaws, which may advantageously be the jaws of an electrical impulse-heating machine. When an electrical impulse heating machine is used, the overlapping portions, after having been joined, may be cooled while still held between such jaws.

As the application of the adhesives commonly used to provide lap joints in continuous wrapping is avoided, the problems attending such application do not arise. A cigar manufacturer can readily produce continuous lengths of wrapping whose joints have sufficient bond strength to permit immediate use of the wrapping in a cigar over-rolling machine. However, in some cases there may be a tendency, especially when the cigars are being smoked, for those edges of the lap joints which are at the outer sides of the wrappers to peel outwardly. This problem can be avoided if, prior to the formation of the lap joints between the pieces of tobacco constituting a wrapping, a peel-resistant consolidating agent is applied to at least end portions of the pieces. Such an agent may be applied all over the end portions to be overlapped, but is preferably applied at those margins only of the said portions which are intended to be at the outer side of the wrapping. The bond strength of the lap joints, especially the shear resistance thereof, is produced as a result of the application of heat and/or pressure as previously described, the bond strength being attainable substantially immediately. The consolidating agent itself has poor shear-resistance, but significantly increases the peel resistance of the lap joints and thereby maintains the bond at the outer edges of the said joints of the wrapped cigars.

Suitable consolidating agents are classes of cellulose such, for example, as derivatives of methyl celluloses, ethyl celluloses or carboxy methyl celluloses. An alternative suitable consolidating agent might be extracted from tobacco.

Figure 2:
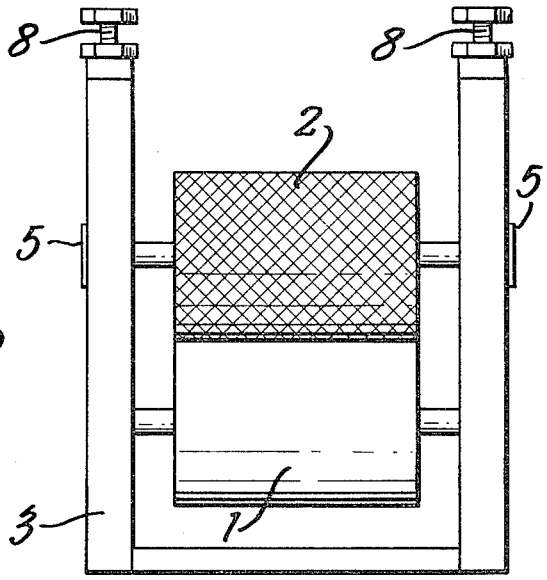
Figure 3:
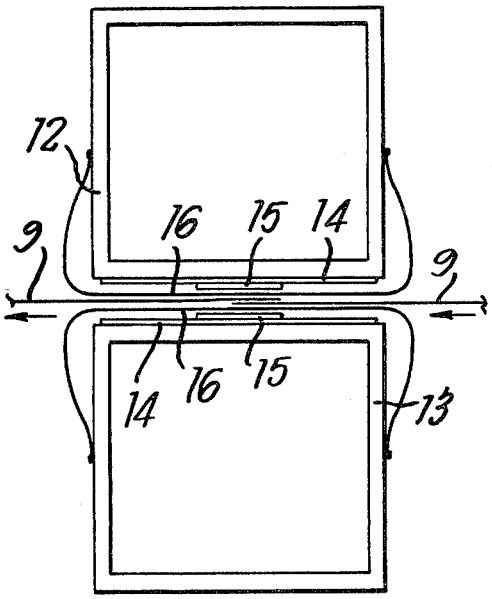
Figure 4:
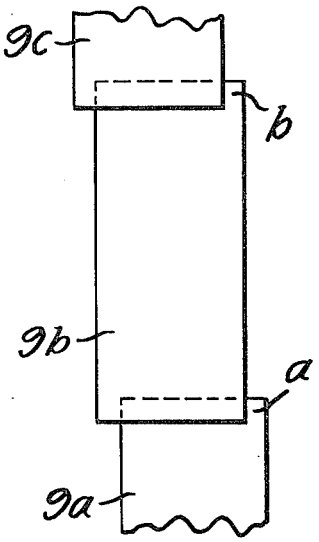
Figure 5:
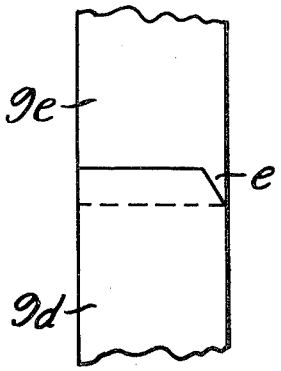
Figure 6:
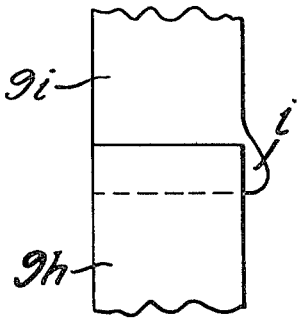

Ways of carrying out the invention will now be described, by way of example, with reference to the production from strips of tobacco of a continuous length of tobacco for use as wrapping in a cigar over-rolling machine. In the accompanying drawings:

FIG. 1 is a side view of ----- apparatus in which bonding is produced by pressure applied between rollers, FIG. 2 is a front view thereof, FIG. 3 is a front view of apparatus comprising an impulse heating machine, and FIGS. 4 to 6 illustrate in plan view three modes of use of tobacco-strips when a consolidating agent is employed.

The apparatus illustrated in FIGS. 1 and 2 comprises lower and upper rollers 1, 2 mounted in a frame 3. The roller 1, which is a steel roller having a rubber surface skin 4, is mounted rotatably in the frame. The roller 2, which is a steel roller, is mounted rotatably in blocks 5 slidable vertically in guides 6 forming part of the frame 3. Through the blocks 5, the roller 2 is pressed downwardly towards the roller 1 by compression springs 7 whose compression and, consequently, the nip pressure between the rollers 1, 2 can be adjusted by screw means 8. By driving means (not shown), the rollers are rotated at equal perepheral speeds. The steel surface of the roller 2 may be embossed, for example with a diamond pattern, to increase the effective contact between overlapping, portions of the strips of tobacco when the apparatus is in use. The rollers may be of the same diameter, as shown, or of different diameters, for example a diameter of 100 mm for the roller 1 and 50 mm for the roller 2. The roller 1 may be at room temperature or may be heated, suitably to a temperature in a range up to 150° C.

Strips 9 cut from tobacco leaf of, say, 30 mm width, but of random length, within limits, preferably at a moisture content within a range of from 20 to 40% by weight, are fed successively on a band 10 between the rollers 1, 2 with an end portion of each strip directly overlapping from 4 to 8 mm of an end portion of the immediately preceding strip. As the overlapping portions of the strips 9 pass through the nip of the rollers 1, 2 they are pressed together and a bond is formed between them without the use of extraneous adhesive. The pressure is selected to obtain the highest bond strength consistent with maintaining an acceptable leaf appearance and is typically 10N to 70N per mm of effective nip length. The continuous wrapping 11 thus formed is reeled onto a bobbin together with a carrier band, which may be the band 10. The reel of wrapping and carrier band is employed at the subsequent over-rolling stage. Once cigars have been wrapped, the lap joints in the wrapping become permanent as the wrapping dries out. The joints remain good when the cigars are smoked and good results are obtainable with a wide range of tobaccos. It is thought that when the overlapping portions of tobacco leaf are pressed together by the rollers 1, 2, natural tobacco juices are forced to the surface of the leaf and act as a binder to augment mechanically induced bonding.

If required, pressure may be applied to the strips of tobacco intermittently, so as to form the lap joints but not to apply pressure to the remaining parts of the strips. However, the application of pressure continuously may have the advantage of increasing the breaking strength of the tobacco intermediate the joints. It may also lead to an increase in length and area of the tobacco, the length being increased by, for example, 2%.

An additional pair of rollers, in tandem with the rollers, 1, 2 may be used.

The impulse-heating machine illustrated in FIG. 3 comprises an upper jaw 12 and lower jaw 13, each comprising a rigid metal beam of box section (see in end view in the figure). The interior of each beam, which is closed at the ends, is utilised as a coolant flow passage provided with coolant inlet and outlet means (not shown). The beams at their opposed faces carry rubber mats 14, overlying each of which is a heating element 15 in the form of a strip of "Nichrome", a high-resistance nickel-chromium alloy, which is in face-to-face contact with the associated mat. Overlying each of the elements 15 is a sheet 16 of buffer material, side edges of which are secured at respective sides of the associated beam. Each element 15 is thus sandwiched between a mat 14 and sheet 16.

The machine also comprises electrical circuitry (not shown) by means of which the heating elements 15 can be activated for a pre-set time. The machine further comprises power means by which the jaws 12 and 13 can be closed to clamp between them pieces of tobacco to be lap joined, the clamping pressure and clamping time being pre-settable.

In operation of the machine, two strips 9 cut from tobacco leaf are placed between the jaws 12 and 13 so that overlapping end portions in contact with each other are disposed between the heating elements 15, as shown in the drawing. After the jaws 12 and 13 have been closed firmly to clamp the overlapping portions, the elements 15 are activated to subject these portions to rapid heating over a short period and cause a rapid rise of temperature thereof. Coolant flow through the interior of each of the beams then causes the overlapping portions to be cooled while they are still held between the jaws 12 and 13. At the conclusion of the cooling period, the jaws 12 and 13 are separated and the joined strips removed or advanced. The sheets 16 of buffer material are such as to ensure that upon separation of the jaws 12 and 13 the tobacco strips 9 do not adhere to the jaws. In this manner, a bond is obtained between the overlapping portions of the strips 9 which is strong in shear. The process can be repeated so as to produce from the strips of tobacco a continuous length of tobacco for, for example, use in a cigar over-rolling machine.

Suitable use is made of strips 9 which are, for example, 30 mm wide and which have a moisture content, prior to the lap-joining process, within a range of from 20 to 40% by weight. In the lengthwise direction of the strips, the lap joint therebetween may measure 4 to 8 mm, for example.

Typical parameters relating to the lap-jointing process are:

Clamping pressure on tobacco strips: 40 $N/cm^2$
Voltage applied to each heating element: 100 v
Heating period: 0.1 second
Cooling period: 5 seconds
Power supplied from each heating element: 1 Kw It is thought that, with other parameters remaining unchanged, the cooling period could be reduced to 0.5 second and an adequate bond still be obtained.

Various modifications may be made to the machine. Instead of using identical upper and lower jaws 12 and 13, one jaw as described above may co-operate with a jaw having a resilient mat supported by a rigid member, but having no heating element. Also the or each heating element strip 15 may be disposed so that a side edge thereof is presented to the tobacco to produce a narrow bonding zone.

The tobacco strips may be subjected to rapid heating by other than impulse heating. Microwave or radio-frequency heating may be used or an ultrasonic process utilized.

Examples of use of a peel-resistant consolidating agent will now be described. In a first example, a 1.2% by weight aqueous solution of a water-soluble ethylhydroxmethyl cellulose marketed by Mo Och Domsjo A.S. of Strandvagen, Sweden, under the Trade Mark "Modocoll" is applied, as consolidating agent, at an end region of each of a series of strips of tobacco leaf. The strips are placed in overlapping relationship with the treated region of each preceding strip placed in contact with the following strip and the strips are fed between a pair of rollers, as in FIG. 1, so as to press the overlapping portions together, the pressure producing a bond therebetween, so that a length of wrapping is formed which may be employed immediately in an over-rolling machine to wrap cigars. Because of the effect of the consolidating agent, the lap joints of the cigar wrapping do not peel back at their outer edges when the cigars are smoked. At the above concentration, the aforesaid agent is not an adhesive for tobacco leaf. If an attempt were made to use it as an adhesive to produce a lap joint, the concentration would have to be about 10% by weight and a long drying time would be required before any significant bond was obtained. Even then, the bond could not be relied upon for producing a length of wrapping for effective use in the overrolling machine. The drying time might be so long that a danger of mould formation on the tobacco would exist.

In the above example, the consolidating agent is in contact at each joint with the overlapping portions of both strips. However, arrangements are possible in which there is no consolidating agent between these portions, but rather an area of one of the strips laterally of the lap joint is left exposed, i.e. not overlain by the other strip, and the consolidating agent is applied to the exposed area. On wrapping a cigar with a length of wrapping having lap joints thus produced, the exposed areas, treated with the consolidating agent, are arranged to face inwardly and are disposed at the outer edge of the wrapping. In this way, peeling back of the lap joints from the outer edge thereof is prevented.

Referring to FIG. 4, lap joints are formed between strips 9*a*, 9*b* and 9*c* —— of tobacco leaf in one of the ways described, so as to form a continuous length of wrapping. The strips are disposed parallel to each other, but each strip is offset somewhat to the left in relation to the preceding strip. Thus, to the right of the lap joint between strips 9*a* and 9*b*, a small area a of strip 9*a* is left exposed, i.e. is not overlain by strip 9*b*. A corresponding area of each strip, e.g. the area b of strip 9*b*, is similarly left exposed. Consolidating agent is applied to the areas a and b, and corresponding exposed areas of preceding and succeeding joints (not shown) of the length of the wrapping, prior to the wrapping being used to wrap cigars.

The lap joined tobacco leaf strips of FIGS. 5 and 6 are not offset. Prior to joining, however, each of the strips is given a configuration which results in an area of one strip, laterally adjacent to each joint, remaining uncovered by the other strip.

Thus the strip 9*d* of FIG. 5 is cut across a corner thereof to leave exposed a triangular area e of the strip 9*e* prior to the formation of the lap joint between strips 9*e* and 9*d*. A rectangular corner portion of one strip may be left similarly exposed by removal of a rectangular portion of the other --- strip. The strip 9*i* of FIG. 6 is provided with a laterally projecting lobe i which remains exposed when strips 9*h* and 9*i* are lap jointed. Consolidating agent is applied to the exposed areas such as e and i, before the lengths of wrapping are used. The agent may be applied to the said areas, while the edge at which they are located, i.e. the outside edge, is fed past an applicator.

Alternatively, exposed areas may be treated with an hydroxy propyl cellulose.

We claim:

1. A method of lap joining pieces of natural tobacco, wherein the said pieces are placed in overlapping relationship and the overlapping portions thereof are cohered to each other, without adhesive to effect the joining, by the application to them of pressure.

2. A method according to claim 1, wherein pressure is applied by passing the pieces of tobacco in overlapping relationship between rollers.

3. A method according to claim 1, wherein pressure is applied by passing the pieces of tobacco in overlapping relationship between rollers, one of a pair of said rollers having a hard metal surface and the other an elastomeric skin.

4. A method according to claim 3, wherein the metal surface of the said one roller has an embossing pattern.

5. A method according to claim 1, wherein a continuous wrapping formed by the lap-joined tobacco pieces is reeled together with a carrier band.

6. A method according to claim 1, wherein pressure is applied between jaws of an electrical impulse-heating machine.

7. A method according to claim 6, wherein a jaw-heating element is sandwiched between a layer of elastomeric material and a buffer material.

8. A method according to claim 6, wherein the overlapping portions of the tobacco pieces lap joined by the rapid application of heat and by pressure between the jaws are cooled while still held between the said jaws.

9. A method according to claim 1, wherein a peel-resistant consolidating agent is applied to end portions of the tobacco pieces.

10. A method according to claim 1, wherein a peel-resistant consolidating agent is applied at those margins of the tobacco pieces which will be the outer margin of a continuous wrapping formed by the lap joining.

11. A method according to claim 9, wherein an area of one of the pieces laterally of a lap joint is left exposed for the application of the agent.

12. A method according to claim 11, wherein each said piece is offset laterally in relation to the preceding piece.

13. A method according to claim 11, wherein each said piece has a configuration by which a said area is left exposed.

14. A method according to claim 1 wherein the joining is also effected by application of rapid heating.

* * * * *